US005199511A

United States Patent [19]

Tibbitts et al.

[11] Patent Number: 5,199,511

[45] Date of Patent: Apr. 6, 1993

[54] DRILL BIT AND METHOD FOR REDUCING FORMATION FLUID INVASION AND FOR IMPROVED DRILLING IN PLASTIC FORMATIONS

[75] Inventors: Gordon A. Tibbitts; Craig H. Cooley, both of Salt Lake, Utah

[73] Assignee: Baker-Hughes, Incorporated, Salt Lake City, Utah

[21] Appl. No.: 760,584

[22] Filed: Sep. 16, 1991

[51] Int. Cl.[5] ..... E21B 21/00

[52] U.S. Cl. ..... 175/65; 175/393; 175/399

[58] Field of Search ..... 175/329, 340, 343, 312, 175/339, 65

[56] References Cited

U.S. PATENT DOCUMENTS

| | | | |
|---|---|---|---|
| 4,253,533 | 3/1981 | Baker | 175/329 |
| 4,342,368 | 8/1982 | Denman | 175/410 |
| 4,696,354 | 9/1987 | King et al. | 175/329 |
| 4,776,411 | 10/1988 | Jones | 175/329 X |
| 4,780,274 | 10/1988 | Barr | 175/329 X |
| 4,792,001 | 12/1988 | Zijsling | 175/329 |
| 4,887,677 | 12/1989 | Warren et al. | 175/339 |
| 4,941,538 | 7/1990 | King | 175/329 |
| 4,981,183 | 1/1991 | Tibbitts | 175/244 |

FOREIGN PATENT DOCUMENTS

| | | | |
|---|---|---|---|
| 322347A | 6/1989 | European Pat. Off. | 175/329 |
| 794147 | 10/1979 | U.S.S.R. . | |

OTHER PUBLICATIONS

Eastman Christensen Coregard Brochure, "Low Invasion Coring System".

"New Coring System Reduces Filtrate Invasion", Gordon A. Tibbitts, M. G. Reed and M. McCarter, from "Advances in Core Evaluation, Accuracy and Precision in Reserves Estimation", May 23, 1990, Gordon & Breach Science Publishers.

*Primary Examiner*—Ramon S. Britts
*Assistant Examiner*—Frank S. Tsay
*Attorney, Agent, or Firm*—Marger, Johnson, McCollom & Stolowitz

[57] ABSTRACT

A drill bit and method in which polycrystalline diamond cutters mounted on a bit crown cut formation chips akin to the manner in which a grater cuts cheese. Chips in impermeable or plastic formations are extruded by the cutters into cavities internal to the bit via slots adjacent each cutter. Drilling fluid circulates internally of the bit from the drill string and into the annulus above that portion of the bit bearing cutters. In one embodiment, the portion of the bit body upon which the crown is formed is made of an elastomer which is pressurized into sealing engagement with the bottom of the borehole thereby further sealing freshly cut formation from drilling fluid.

45 Claims 5 Drawing Sheets

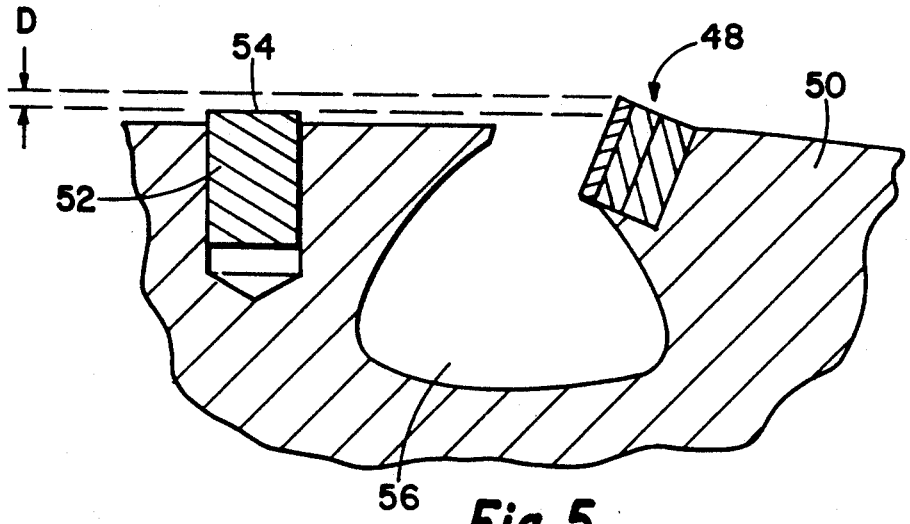
Fig. 5
Fig. 6
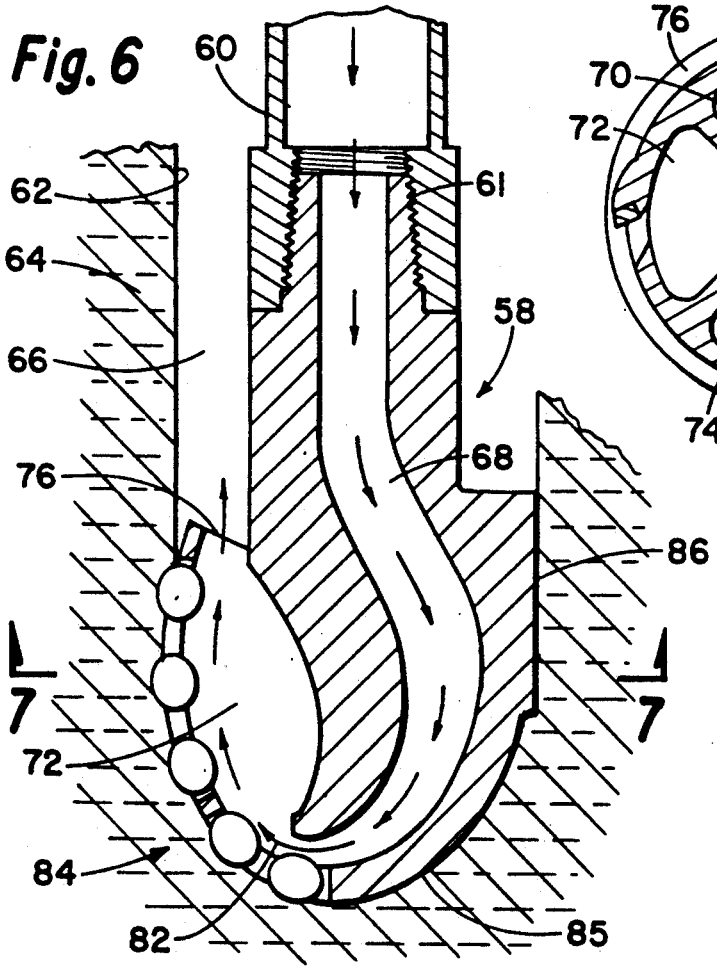
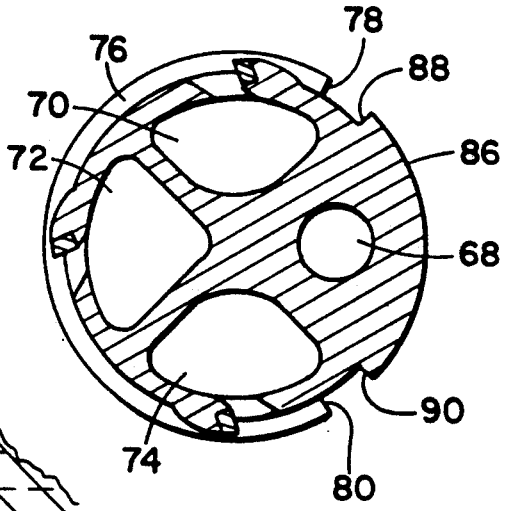
Fig. 7

Fig. 11
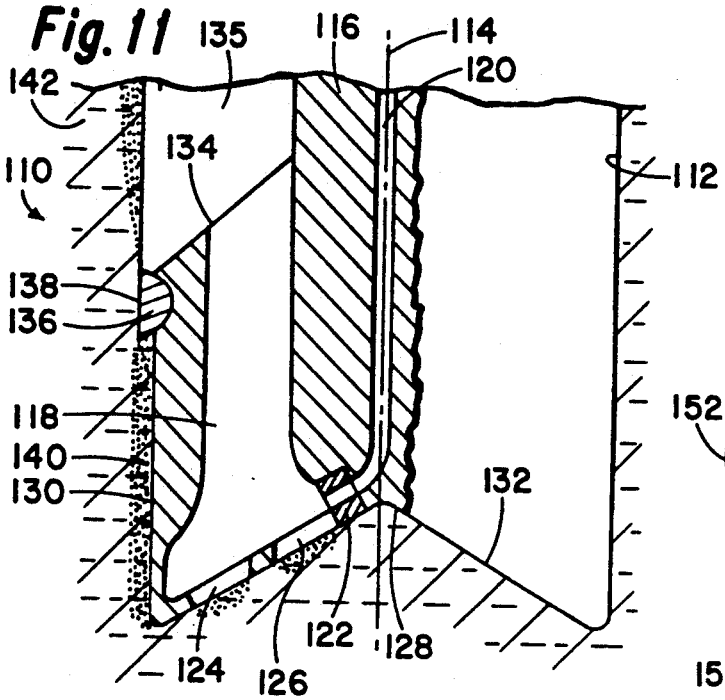
Fig. 12
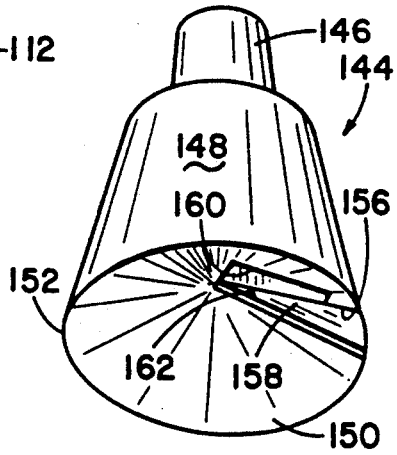
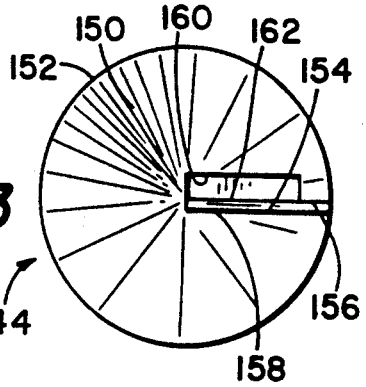
Fig. 13
Fig. 14
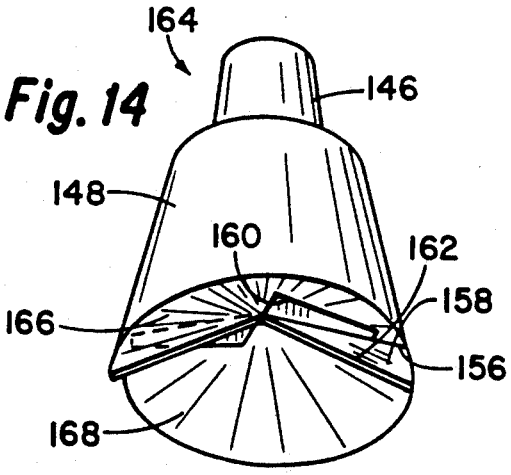
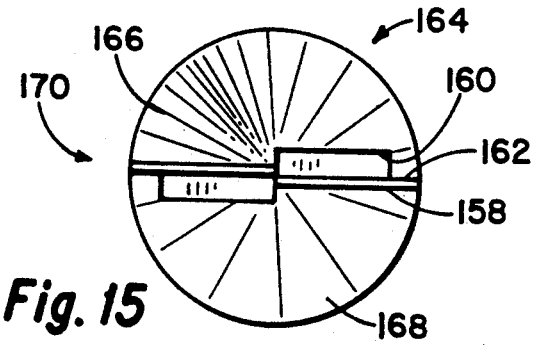
Fig. 15
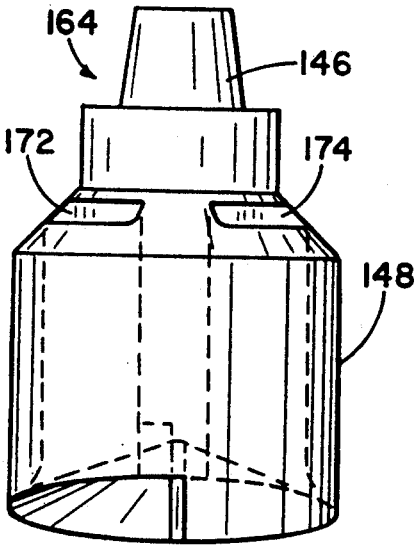
Fig. 16

DRILL BIT AND METHOD FOR REDUCING FORMATION FLUID INVASION AND FOR IMPROVED DRILLING IN PLASTIC FORMATIONS

BACKGROUND OF THE INVENTION

1. Field of the Invention

The present invention relates to drill bits and methods for reducing formation fluid invasion in permeable formations and for improved drilling in plastic formations and more particularly to a new bit and method in which formation cuttings are received into a cavity inside the bit and then circulated to the top of the borehole.

2. Description of the Related Art

In rotary drilling of earth formations, it has long been the practice to irrigate the cutting face of the drill bit with drilling fluid during drilling. In the usual case, drilling fluid is injected into a drill string at the top of the borehole. A drill bit is suspended from the lower end of the drill string. The bit includes a plurality of openings, sometimes formed as nozzles, on the cutting face thereof to communicate drilling fluid to the space between the drill bit and the bottom of the borehole being cut. The fluid then flows up the annulus between the drill string and the borehole carrying chips cut from the borehole bottom to the surface of the borehole. In addition to flushing cut chips from the borehole, the fluid cools the drill bit.

The drilling fluid typically includes a combination of solids, polymers, viscosifiers and other agents to form filtercakes on well bore surfaces. In permeable formations, the filtercake prevents liquid in the drilling fluid from invading the formation. Such liquid is referred to as filtrate. Particles and polymers contained in the drilling fluid are driven into the pores of the formation being drilled to bridge and plug flow paths thereby preventing filtrate from permeating very far into the formation.

For a formation with a given permeability, the extent to which filtrate invasion occurs is a function of: (a) total time the borehole surface is subjected to drilling fluids; (b) the degree to which the formation can be made impermeable to filtrate at the well bore surface; and (c) the flow rate of the drilling fluid circulated in the well bore.

When drilling with conventional bits having polycrystalline diamond cutters mounted thereon, a filtercake forms in the well bore above the lower end of the bore where cutting action occurs. Although filtercake begins forming immediately on a freshly cut surface, the usual drill bit includes cutters positioned so that a filtercake formed on a cut surface made by a leading cutter is at least partially cut into by a closely following cutter. Such action is disadvantageous for two reasons.

First, continuous cutting into the filtercake disturbs the barrier to filtrate presented by the filtercake thereby permitting additional filtrate migration into the formation.

Secondly, the pressure gradient across the filtercake is high, having the well bore drilling fluid pressure on one side and the naturally-occurring formation pore pressure on the other. Under some conditons, this pressure differential effectively strengthens the formation and thus makes cutting into the invaded portion of the formation more difficult than if the cut extended into the formation beyond the formation invasion depth. The lower drilling rate thus exposes the formation to the drilling fluid for a longer period of time thereby causing increased drilling fluid invasion into the formation.

It clearly would be desireable to provide a method and bit for drilling, especially in a permeable formation from which production is contemplated, which minimizes filtrate invasion into the formation while still using drilling fluid, which is necessary to flush cuttings from the borehole and cool the bit.

The above described conditions and associated problems are encountered in permeable formations. Conditions are different, and cause different associated problems, when drilling plastic formations. In plastic or sticky formations, low permeability can prevent substantially all filtrate invasion from the borehole into the formation. When a bit having polycrystalline cutters mounted thereon drills through such a formation, the rock in the formation extrudes around the cutter structure thus balling and clogging the bit and substantially lowering the drilling rate.

It would also be desireable to provide a bit and drilling method which addresses the disadvantages associated with drilling in a plastic formation.

In all types of formations, drilling fluid flow is limited by the space between the surface of the bit and the borehole in which the bit is drilling. Most bits have junk slots which are vertical grooves formed about the circumference of the bit to increase the cross-sectional area through which drilling fluid and rock chips carried therein can flow. It would be desirable to increase the flow rate of drilling fluid thereby increasing the rate at which the bit is cooled and the rate at which chips are flushed from the borehole while minimizing exposure of freshly cut formation to drilling fluid.

SUMMARY OF THE INVENTION

The present invention provides a method and drill bit for drilling a borehole in an earth formation in which a cutting edge is embedded in the formation at the bottom of the borehole. The cutting edge is advanced thereby cutting or extruding formation chips from the formation. Drilling fluid flushes the formation chip to the surface while a substantial portion of the bottom of the borehole is sealed from drilling fluid.

In a more particular aspect of the invention, drilling fluid circulated down a drill string from which a bit is suspended is circulated into and out of a plenum formed in the bit. Chips are cut or, in the case of a plasticly deformable formation, extruded into the plenum, via slots adjacent cutting edges formed on the exterior of the bit, and thereafter flushed with the drilling fluid to the surface of the borehole.

In another more particular aspect of the invention, the cutting edges and bit profile are configured to minimize exposure of freshly cut formation to drilling fluid and to minimize disturbance to filtercake formed on the borehole wall and in close proximity to the bottom of the borehole.

The present invention overcomes the above-enumerated disadvantages associated with drilling in both permeable and plasticly deformable formations. It also increases the cross-sectional area in the drill bit and annulus at the bottom of the borehole through which chips and fluid flow. The present invention also provides increased gauge contact without adversely affecting the hydraulics of drilling fluid and chip flow and further provides structure which produces a rock chip within a desirable size range when drilling in both permeable and plastic formations.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 5 is a highly diagrammatical view of a third embodiment of the present invention similar to FIG. 4B.

FIG. 6 is a highly diagrammatic sectional view of a fourth embodiment of a drill bit constructed in accordance with the present invention received in a borehole in position for drilling.

FIG. 7 is a view taken along line 7—7 in FIG. 6.

FIG. 11 is a highly diagrammatic depiction in sectional view of another embodiment of a drill bit, with a portion thereof broken away, constructed in accordance with the present invention and being shown received in a borehole.

FIG. 12 is a highly diagrammatic perspective view of a another embodiment of a drill bit constructed in accordance with the present invention.

FIG. 13 is a plan view of the crown of the drill bit of FIG. 12.

FIG. 14 is a highly diagrammatic perspective view of another embodiment of a drill bit constructed in accordance with the present invention.

FIG. 15 is a plan view of the crown of the drill bit of FIG. 14.

FIG. 16 is a side elevation view of the drill bit of FIGS. 14 and 15.

DETAILED DESCRIPTION OF THE PREFERRED EMBODIMENTS

Figure 1:
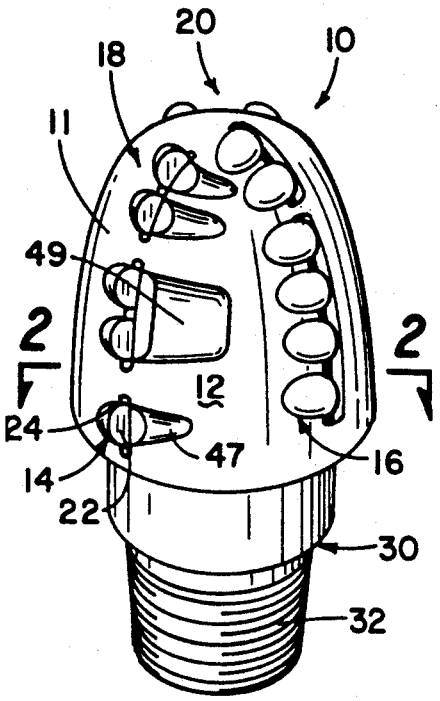
FIG. 1 is a highly diagrammatic perspective view of a drill bit constructed in accordance with the present invention.

Indicated generally at 10 in FIG. 1 is a drill bit constructed in accordance with the present invention. As used herein, the term drill bit encompasses coring bits also as the invention may also be implemented in a coring bit. The drill bit includes a body 11 having a crown 12, which comprises an exterior surface of bit body 11, upon which a plurality of cutter, like cutters 14, 16 and cutter 17 (in FIG. 3) are mounted. In the present embodiment, the cutters are arranged in four rows or blades with cutters 14, 17 comprising cutters in blade 18 and cutter 16 comprising one of the cutters in blade 20. In the present embodiment, each blade is displaced by 90° from the adjacent blades on the surface of crown 12. Bit body 11 can be formed from ductile alloys using known investment casting techniques or machining or by infiltrating matrix powders known in the art or by other techniques also known. The cutters can be bonded, as by brazing, to the bit body after it is cast.

Each cutter includes a cutting surface, like cutting surface 22 on cutter 14, and a cutting edge, like cutting edge 24. Similarly, cutter 17, in FIG. 3 includes a cutting surface 26 and a cutting edge 28. The cutting edge of each of the cutters are that portion of the cutting surface perimeter which extends above crown 12 as viewed in FIGS. 2 or 3.

Drill bit 10 further includes a shank 30 having a threaded portion 32 which is threadably connectable to the lower end of the string of drill pipe.

Figure 2:
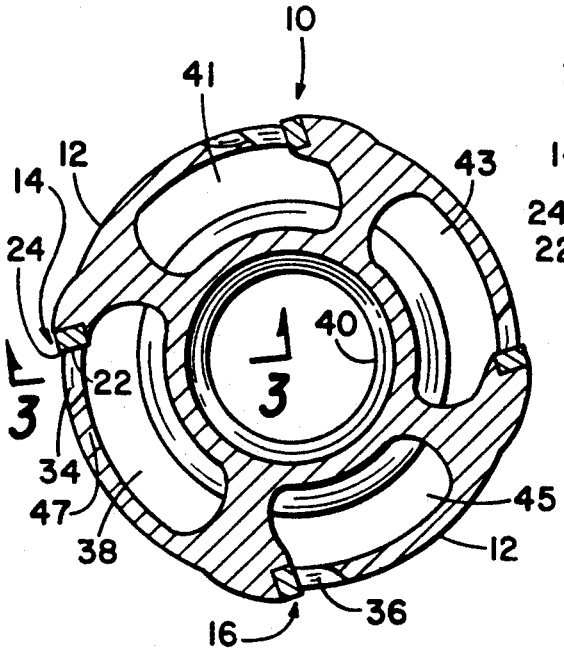
FIG. 2 is a view taken along line 2—2 in FIG. 1 and rotated about 45° clockwise from the view of FIG. 1.

Drill bit 10 includes a plurality of flow channels or slots, like slot 34 adjacent cutter 14 and slot 36 adjacent cutter 16 in FIG. 2. Slot 34 is defined between cutting surface 22 and a portion of bit body 11 spaced away from cutting surface 22. Slot 34 includes an exterior opening which communicates with the exterior of bit body 11 and an interior opening, which communicates with a cavity 38, in FIG. 3, defined inside the bit body. Cavity 38 is in fluid communication with a bore 40 which in turn is in fluid communication with a drill string (not shown in FIG. 3) threadably engaged with threaded portion 32 of the drill bit. Bore 40 includes ports 42, 44, as well as other ports not visible in the view of FIG. 3, which permit fluid flow into cavity 38 and into cavities 41, 43, 45, in FIG. 2. Each of cavitite 38, 41, 43, 45 is substantially symmetrical with respect to the other cavities and each cooperates with associated cutters and slots in the same manner that cutter 14 and slot 34 cooperate with cavity 38 in FIG. 4. The invention can also be implemented with asymmetrical cavities and/or with a different number of cavities.

A plurality of extrusion channels, like channels 47, 49, are formed on crown 12. The maximum depth of each channel is closely adjacent the face or faces of cutters associated with the channel, like surface 22 of cutter 14 in FIGS. 1 and 2 and like the cutting faces of the cutters associated with channel 49 in FIG. 1. From there each channel gradually slopes to crown 12. As will later be described in more detail, when drilling in plastic formations, plastically deformable formation extrudes into the channels as the bit rotates. Further rotation extrudes formation in the channel into the slot, like slot 34, and against the cutting face. Continued rotation causes the formation extruded in to the slot to be cut by the cutting edge, like cutting edge 24. This action is similar to the manner in which cheese is cut by a grater when the cheese is pressed against the drawn across the grating surface.

For the purpose of illustration, cutter 16 and a cutter adjacent thereto in FIG. 2 are shown without opposing extrusion channels. The invention could be implemented without utilizing extrusion channels in the manner shown in FIG. 2.

Figure 3:
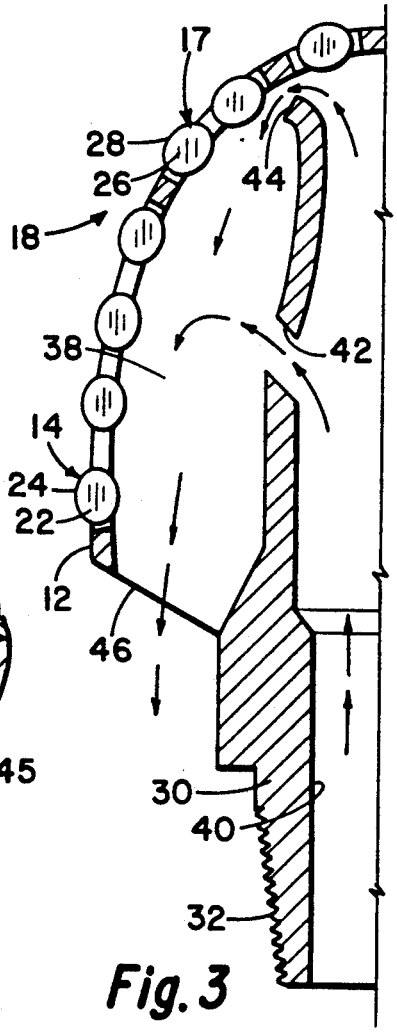
FIG. 3 is a view taken along line 3—3 in FIG. 2.

The arrows internal to bore 40 and cavity 38 in FIG. 3 illustrate drilling fluid flow through the drill string and into the drill bit. A return flow channel vent 46 is formed about the circumference of the drill bit just beneath, as viewed in FIG. 3, crown 12.

Figure 4B:
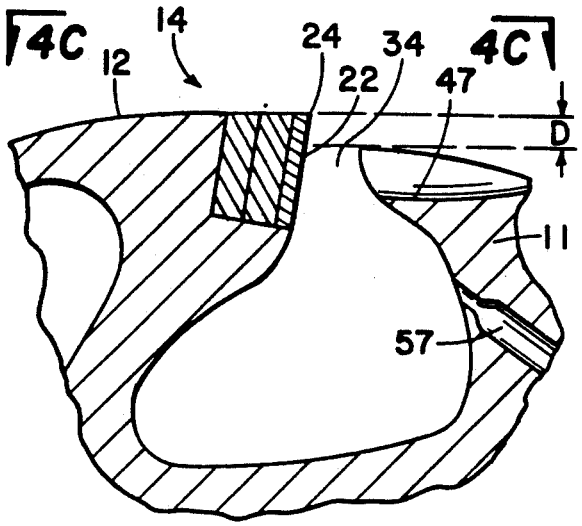
FIG. 4B is a partial, enlarged view taken along line 4B—4B in FIG. 4A.
Figure 4C:
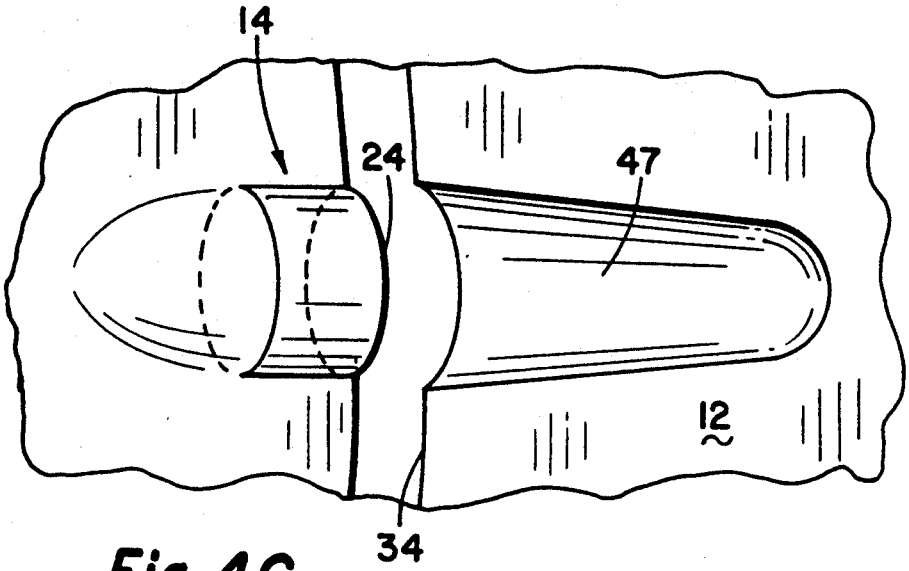
FIG. 4C is a slightly enlarged view taken along line 4C—4C in FIG. 4B.
Figure 4A:
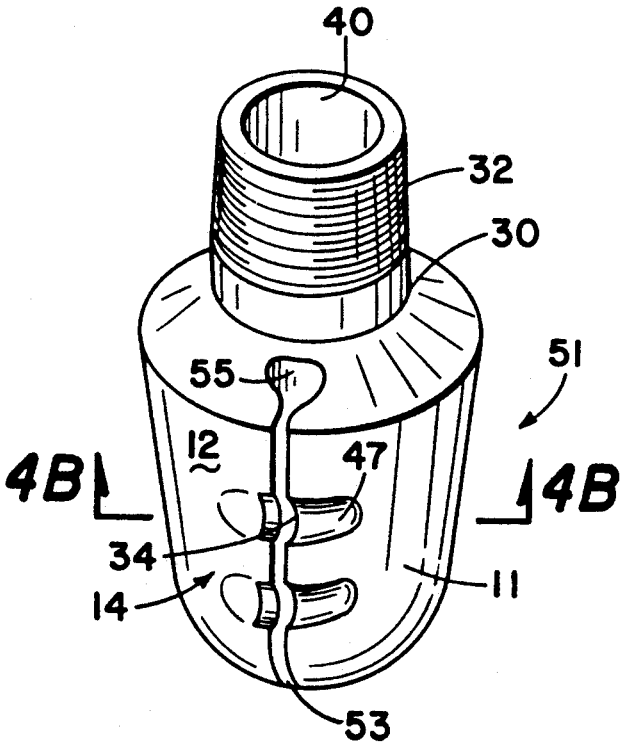
FIG. 4A is a highly diagrammatic perspective view of a second embodiment of a drill bit constructed in accordance with the present invention.

Turning now to FIGS. 4A, 4B and 4C, indicated generally at 51 in FIG. 4A is another embodiment of a drill bit constructed in accordance with the present invention. Numerals which correspond to previously identified structure on bit 10 are used to identify generally corresponding structure on bit 51. The primary difference between the two embodiments is an external fluid course, indicated generally at 55, having an upper opening 55. The lower end of fluid course 55 is in fluid communication with the lower end of bore 40. Additional fluid courses (not visible), like fluid course 53, are formed about the circumference of the drill bit. Drilling fluid pumped down the drill string circulates out of the lower end of bore 40 and into the external fluid courses, like fluid course 53, formed on the drill bit.

In bit 51, the slots, like slot 34, which are situated between a cutter and its opposing extrusion channel are continuous from the bottom to the top of each external fluid course. The fluid courses in bit 51 serve the same function as cavities 38, 41, 43, 45 in bit 10, i.e., fluid circulates in each fluid course substantially normal to the direction of cut along the axis of the cavity. Such fluid flow serves the usual function of cooling the bit and cutters. In addition, in plastic formations, the fluid flow knocks a chip from the formation as it is extruded into the fluid course and thereafter circulates the chip upwardly out of upper opening 55 and from there to the formation surface.

In FIG. 4B an optional nozzle 57 is formed in bit body 11 for directing a high pressure jet of drilling fluid at surface 22 on cutter 14. Such action further prevents balling and clogging of cutter 14.

Directing attention now to FIG. 5, illustrated therein is a view of a slightly modified embodiment similar to the view of FIG. 4. Included therein is a polycrystalline diamond compact (PDC) cutter 48 which is fabricated and installed in an investment cast bit body 50 using known techniques but which may be fabricated using other known techniques. Also cast therein is a tungsten carbide land 52 which the provides an external wear pad surface 54 against which formation rides during cutting. Other known and suitably hard materials may be used instead of tungsten carbide. A controlled depth of cut, designated D in FIG. 5, is provided which limits the size of a formation chip cut into the cavity 56 and the depth of cut as will be described hereinafter in more detail. Cavity 56 cooperates with other structure internal to bit body 50 which may be substantially identical to that described in either of bits 10, 51.

Turning now to FIGS. 6 and 7, particularly with reference FIG. 6, a drill bit, indicated generally at 58, is suspended form the lower end of a drill string 60 via threaded connection 61. Bit 58 is received in a borehole 62 formed in an earth formation 64. Formation 64 tends to deform in a plastic manner responsive to drilling rather than having chips cut therefrom as in a relatively hard formation. The space between the drill string and bit 58, on the one hand, and the radially inner surface of borehole 62 comprises an annulus 66. Bit 58 includes a flow channel 68 which provides fluid communication of drilling fluid from drill string 60 into three cavities 70, 72, 74, formed in drill bit 58.

Like drill bits 10 of FIGS. 1–3, bit 58 includes a return flow channel vent 76. Vent 76, however, does not extend entirely about the circumference of the bit, but rather includes opposing ends 78, 80, in FIG. 7. Thus, fluid entering channel 68 flows to cavity 72 via a port 82, in FIG. 6. Fluid flows from the cavity through vent 76 and into annulus 66. Other ports (not visible) like port 82 communicate fluid from channel 68 into each of cavities 70, 74 and from there out vent 76 and into the annulus.

A blade 84 of cutters, constructed like blade 18 in the embodiment of FIG. 3, is illustrated embedded in the formation. A crown 85 comprises the surface of the drill bit from which the cutters extend. Each cutter can only be embedded to the extent of the controlled depth of cut, D, illustrated for bit 51 in FIG. 4B. As with bit 51, the depth of cut can be changed by varying the extend to which each cutter extends above crown 85.

Bit 58 includes a wear pad 86 defined between pad ends 88, 90. The wear pad presents a low friction surface directly against the interior side of the bore This is a known technique for providing an imbalanced bit which is forced to one side of the bore and thus prevents whirl during drilling.

Figure 8:
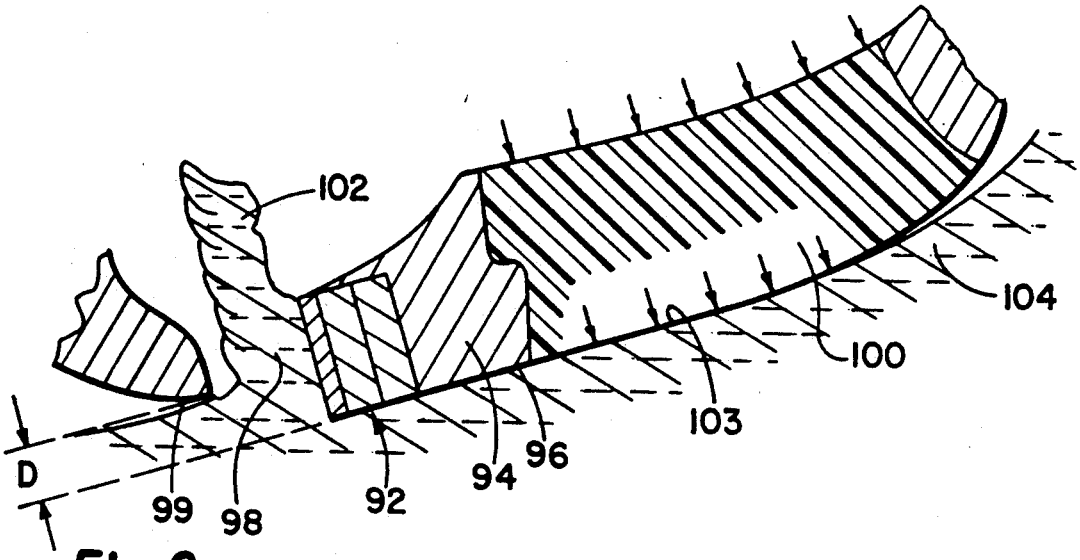
FIG. 8 is an enlarged sectional diagrammatic view of a fifth embodiment of the present invention similar to the view of FIG. 5 and shown in cutting relationship with a rock formation.

Turning now to FIG. 8, illustrated therein is another embodiment of the present invention similar to the views of FIGS. 4B and 5 and including a conventional PDC cutter 92 mounted on a bit body 94. The bit body presents an exterior surface or crown 96 and includes a slot 98 defined between the surface of cutter 92 and an opposing portion 99 of crown 96 similar to slot 36 in FIG. 4. In the embodiment of FIG. 8, a portion 100 of the bit body is formed of an elastomeric material such as urethane. As used herein, the term elastomeric material may refer to an elastomer which is reinforced with wire or other reinforcing material and which may have an abrasion-resistant grit, such as tungsten carbide or the like, embedded therein. In the view of FIG. 8, the drill bit is shown in operative condition cutting a formation chip 102 from a formation 104 in a borehole 103.

Figure 9:
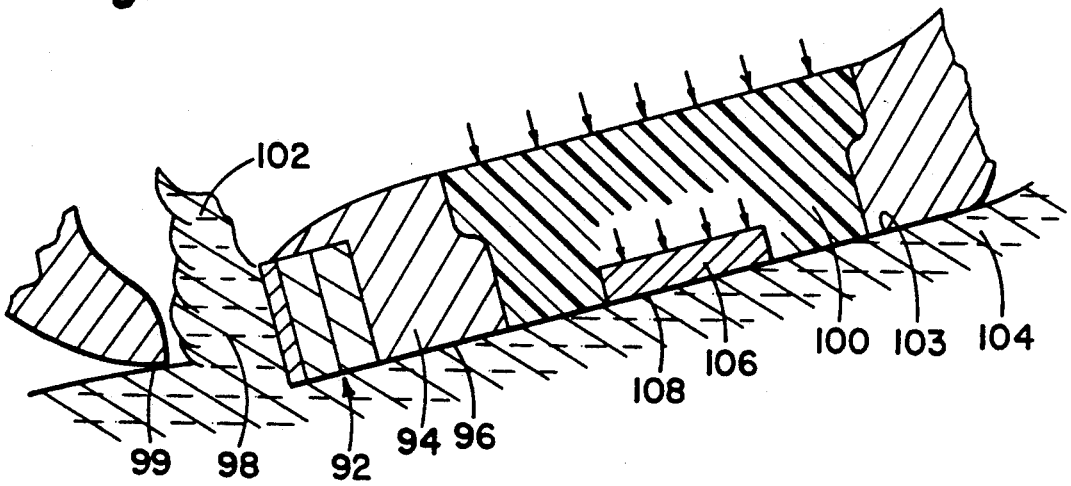
FIG. 9 is a diagrammatic view similar to FIG. 8 illustrating a sixth embodiment of the present invention.
Figure 10:
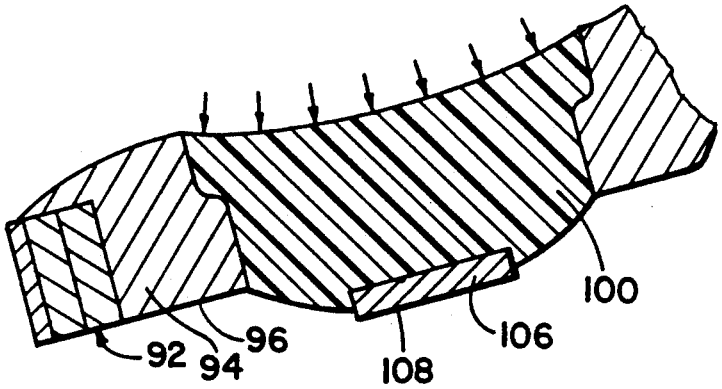
FIG. 10 is a view of the embodiment of FIG. 9 illustrated in its expanded configuration for sealing against the borehole.

FIGS. 9 and 10 illustrate a slightly different embodiment from the one shown in FIG. 8. Like numbers in FIGS. 9 and 10 correspond to structure identified and described in FIG. 8. In FIG. 9, a metal wear pad 106 made from, e.g., tungsten carbide or other suitable abrasive-resistant material, is molded into segment 100. Pad 106 includes an outwardly directed surface 108 which is urged against the radially inner surface of borehole 103.

Operation of the embodiments illustrated in FIGS. 1–10 will be undertaken with reference primarily to the views of FIGS. 6 and 7, and with reference to other figures where appropriate. Generally, operation of the embodiment of FIGS. 6 and 7 corresponds to similar operation in the other embodiments.

Initially, drill bit 58 is suspended from the lower end of drill string 60 and lowered into borehole 62. Crown 85 is urged against the lower end of the borehole thereby embedding the cutters in blade 84 into formation 64 to the extent of the depth of cut D illustrated in FIGS. 4C, 5 and 8. As used herein, reference to the borehole bottom refers to that portion of the borehole immediately below the highest (as viewed in FIG. 6) cutter mounted on the drill bit. In other words, the bottom of the borehole is that portion of the borehole in which cutting action is occurring.

With the bit positioned in the borehole as illustrated in FIG. 6, drilling fluid circulates into flow channel 68, through cavities 70, 72, 74 and out vent 76 into the annulus. At the same time, drill string 60 rotates at the surface of the well bore thereby rotating the bit in a counterclockwise, as viewed in FIG. 7, direction. When such occurs, formation chips, like chip 102 in FIGS. 8 and 9, are extruded through the slots associated with each cutter and into the bit cavity adjacent the slot. The extrusion effect is most pronounced in plastic or sticky formations which tend to ball and clog prior art bits.

The cutting action provided by the bit of the invention is akin to that of a cheese grater in that there is a controlled depth of cut D, in FIGS. 4C, 5 and 8, which defines chip thickness regardless of the amount of force applied to the bit urging it against the bottom of the borehole. In FIG. 5, land 52 presents a surface 54 against which the formation rides just prior to encountering cutter 48. In FIGS. 4C and 8, the formation rides against the crown of the bit just prior to encountering the cutter. In each embodiment, the depth of cut is limited to a predetermined thickness, D. This feature facilitates using a positive rake cutter which tends to embed itself in the formation due to the screwing action imparted by the cutters. Limiting the depths of cut as described counteracts this tendency.

As chip 102 enters the bit cavity, drilling fluid sweeps across the interior of the slot as it flows to the vent thereby knocking the chip from the formation. Port 44 is sized and oriented to create a jet of drilling fluid aimed at the interior openings of adjacent slots thereby knocking the chips loose from the formation as they enter the bit cavity. Chips cut by each cutter are thus flushed upwardly into the annulus and from there to the surface.

Such action is beneficial in that greater rates of flow for drilling fluid are possible because of the increased cross-sectional flow area when compared with the prior art cross-sectional flow area defined between the bit crown and the bottom of the borehole. Greater drilling fluid flow rates transport chips away at a quicker rate. The internal structure facilitates better cooling of the bit thus increasing drilling rates. Bit cooling is also enhanced by the fact that drilling fluid is exposed to those cavity surfaces in the bit directly adjacent that portion of the bit body which defines crown 85. Thus, a large surface area of drilling fluid is continuously exposed to that portion of the bit in which the most heat is generated. The profile of bit 58 provides increased gauge contact with the formation. The gauge is that portion of the bit surface urged substantially laterally against the borehole. Increased gauge contact occurs without adversely effecting the hydraulics, which are substantially internal, and provides a stabilizing, anti-whirl effect.

It is to be appreciated that the present invention could also be implemented in a drill in which return of drilling fluid to the annulus above the bit is through the bottom of the bit and between the bit crown and the borehole.

Although not illustrated in a drawing, it may be necessary or desirable to provide ports which communicate between the cavities and the crown of the bit at various locations to provide some drilling fluid flow between the crown and the bottom of the borehole thereby lubricating this interface. It can be seen that with or without such ports, the amount of drilling fluid exposed to that portion of the formation being cut is greatly reduced when compared with prior art bits in which all drilling fluid circulates between the bit crown and the bottom of the borehole. Although the embodiment of FIG. 6 is illustrated drilling in a formation of relatively low permeability, variations in formation permeability are encountered as drilling proceeds. When utilizing bit 58 in a relatively high permeability formation, so minimizing the quantity of fluid exposed to the bottom of the borehole minimizes invasive filtrate damage to the formation.

With reference to the views of FIGS. 8–10, drilling fluid under pressure in the bit cavities provides a pressure differential between the interior and exterior of the bit which causes portion 100 of the bit to expand into sealing engagement with the side of the borehole thus further sealing freshly cut portions of the bottom of the borehole from drilling fluids. Wear pad 106 increases the life of portion 100 by providing a wear surface 108 which is not as adversely affected by frictional engagement with the bottom of the borehole as is portion 100. As previously mentioned, portion 100 may be impregnated with hard grit, such as tungsten carbide or some other suitably hard material, to increase resistance to wear.

Turning now to FIG. 11, indicated generally at 110 is another embodiment of a drill bit constructed in accordance with the present invention. The drill bit is shown in a borehole 112 with a centerline 114 which is coaxial with the centerlines of both drill bit 110 and borehole 112. In addition, most of the rightside portion of the drill bit is broken away to reveal the shape of the lower end of borehole 112. Bit 110 includes a bit body 116 having a cavity 118 formed therein. A bore 120 is in fluid communication with a drill string (not shown) from which bit body 116 is suspended. Bore 120 communicates with a nozzle 122 which directs flow of drilling fluid from bore 120 across a pair of slots 124, 126. Each of slots 124, 126 includes a cutter (not shown for clarity) associated therewith in the same fashion that cutter 16 is associated with slot 36 in FIG. 2. Each of slots 124, 126 provide fluid communication between cavity 118 and a lower surface 128 of drill bit 110. A plurality of other slots and associated cutters (not shown) are mounted on the lower end of the drill bit in the same fashion as slots 124, 126 and their associated cutters. As will be described hereinafter, rotation of the drill bit causes rock chips to be cut from the formation into cavity 118. Bit 110 includes a radially outer surface 130 from which surface 128 extends upwardly towards centerline 114. The lower surface of the drill bit is thus generally in the shpae of a cone.

Borehole 112 includes a lower surface 132 which extends upwardly between the radially inner surface of borehole 112 and centerline 114 and is generally complementary to the shape of lower surface 128 of the drill bit.

A vent 134 permits fluid communication between cavity 118 and the annulus 135 between the radially outer surface of the drill bit and the radially inner surface of borehole 112.

One or more cutters, like cutter 136, is mounted on the radially outer surface of the drill bit and includes a substantially flat cutting edge 138. The radially inner surface of borehole 112 above cutting edge 138 is formed responsive to action by cutter 136 during drill bit rotation. There may be additional cutters, like cutter 136 mounted on the radially outer surface of the drill bit. Further, drill bit 110 may be constructed substantially symmetrically as in the embodiments of FIGS. 1–4 or asymmetrically as in the embodiment of FIGS. 6 and 7.

Body 11 is especially well suited for drilling through a producing zone in a formation which is permeable. It is known that such drilling can cause damage to the producing formation when drilling fluids containing solids migrate from the borehole into the formation pores. Such filtrate invasion can adversely affect production.

In operation, drill bit 110 is lowered to the lower end of borehole 112, as illustrated in FIG. 11. The drill bit rotates responsive to drill string rotation in the usual fashion. During drilling fluid circulates through the drill string, into bore 120, through nozzle 122, into cavity 118 and through vent 134 into annulus 135. During bit rotation, the cutters (not shown for clarity), like the cutters associated with slots 124, 126, mounted on lower surface 128 of the bit cut into lower surface 132 of the borehole. Rock cuttings cut by a cutter pass through the slot, like slots 124, 126, associated with the cutter into cavity 118 in much the same manner that cuttings pass into the interior cavity of the embodiment of FIGS. 1–4. Nozzle 122 provides a jet of drilling fluid across the interior openings of the slots thereby dislodging the cuttings from the formation and circulating them upwardly in cavity 118.

During drilling, the majority of the drilling fluid circulated downwardly in bore 120 does not pass through slots 124, 126 but rather circulates upwardly in cavity 118. Some drilling fluid, however, passes through the slots. Because of the upward angle of surface 132 relative to the radially inner surface of borehole 112, drilling fluid tends to migrate in the formation toward centerline 114 rather than radially outwardly therefrom. This minimizes the filtrate which flows laterally into the producing formation in the borehole of FIG. 11.

During drilling some of the fluid which passes through slots 124, 126 to the underside of the bit migrates into the formation, but generally in the direction of centerline 114, as described above. Some of the fluid passing through slots 124, 126 circulates upwardly into the annular area between the radially outer surface of bit 110 and the radially inner surface of the borehole beneath cutter 136 thus creating a filtrate damaged zone 140. Such fluid begins lateral migration radially outwardly from the borehole. Before such radial migration extends radially outwardly beyond cutting edge 138, however, cutter 136 cuts away the filtrate damaged zone therebeneath thus limiting radial migration of filtrate into the formation.

The pressure gradient between the drilling fluid in the borehole and that of the naturally-occurring pore pressure in the formation strengthens that portion of the formation through which the gradient appears. When the cutters on the lower end of a bit cut into the pressure gradient, cutting may be more difficult because of the increased strength created by the pressure gradient. Like cutter 136, the cutters on lower surface 128 (not shown) adjacent slots 124, 126 cut beyond the pressure gradient thus permitting faster cutting and therefore exposes the radially inner surface of the borehole to fluid for a shorter time. This further limits radial migration of filtrate into the formation.

Above cutter 136, static filtercake 142 forms on the radially inner surface of the borehole and in the formation immediately adjacent the borehole. The filtercake is made up of the various solids in the drilling fluid and serves to plug and block pores thereby preventing further fluid invasion into the formation. Because the filtercake, once formed, is not continuously cut into as is the case with prior art drill bits, migration of filtrate from the drilling fluid into the formation is reduced.

Turning now to FIGS. 12 and 13, indicated generally at 144 is another drill bit constructed in accordance with the present invention. FIG. 12 is a perspective view of the drill bit which includes a shank 146 for connecting the drill bit to a drill string and a generally cylindrical bit body 148 to which the shank is connected. A lower helical surface 150 has a circular perimeter 152. Surface 150 has a first end 154 and a second end 156 each of which extend substantially along a different radius of surface 150 closely adjacent one another. The lower surface extends upwardly between perimeter 152 and the centerline of the bit.

A vertical cutting blade 158 also extends radially between the center of surface 150 and perimeter 152 between ends 154, 156, which are vertically offset along the length of blade 158 in an amount equal to the height of the blade. Blade 158 includes a cutting edge 162.

A slot is formed through the lower end of the drill bit to permit fluid communication between the exterior of the bit and an interior cavity (not visible). As in previously described embodiments herein, a bore (not shown) in shank 146 communicates with the interior cavity in the drill bit.

Turning now to FIGS 14–16, illustrated therein is another embodiment of a drill bit constructed in accordance with the present invention, indicated generally at 164, which is similar to the embodiment of FIGS. 12 and 13. Corresponding structure in drill bit 164 retains the same numeral as used in connection with the structure in drill bit 144.

Drill bit 164, rather than including a single helical surface, includes a pair of helical surfaces 166, 168, each being vertically offset from the other. Bit 164 further includes another blade and slot combination, indicated generally at 17, located 180° around the bit from slot 160 and blade 158. As in drill bit 144, the slots on the lower end of bit 164 communicate with a cavity internal to the body of bit 164. In FIG. 16, a pair of vents 172, 174 also communicate with the cavity.

It may be desireable to construct a drill bit, like bits 144, 164 in which the angle of cutting edge 162, and thus of the helical surfaces abutting either side thereof, varies continuously between the outer perimeter of the bit and the center thereof with the angle increasing as the center is approached. It is also to be appreciated that a drill bit having a helical lower surface may be equally well implemented with round cutters or cutters formed through diamond film deposition.

In operation, drill bit 164 is suspended from the lower end of a drill string through which drilling fluid is circulated. The fluid circulates into the cavity and the drill bit accross slots at the lower end thereof and up through vents 172, 174 into the annulus between the bit and the borehole. As the bit rotates, cutting edge 162 cuts formation chips which are received through slot 160 into the cavity of the bit. As in previously described embodiments, formation chips are carried by the circulating drilling fluid through vents 172, 174 into the annulus and from there to the top of the borehole. Also as in previously described embodiments, substantially all of the drilling fluid circulates internally of the drill bit until circulated from vents 172, 174 thus minimizing filtrate invasion of the formation. Further, in relatively low permeability formations, the bit tends to extrude relatively plastic chips from the formation as previously described herein, into the bit cavity thus preventing bit balling and clogging as in prior art bits.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A method of drilling a borehole comprising the steps of:

providing a drill bit having a plenum formed therein, a cutter formed thereon and a flow channel adjacent the cutter which connects the plenum with the exterior of said bit;

mounting the bit on the end of a drill string;

rotating the drill string;

pumping fluid down the string and into the plenum;

substantially isolating an earth formation ahead of the drill bit from the plenum;

cutting a chip from the formation; and directing the cut chip into the plenum via the flow channel.

2. The method of claim 1 wherein said method further includes the step of venting drilling fluid and any cut chips therein from the plenum to the annulus between the drill string and the borehole above the cutters on the bit.

3. The method of claim 2 wherein said method further includes the step of urging a substantial portion of the surface of the drill bit crown against the borehole bottom thereby substantially sealing the borehole bottom from drilling fluid.

4. The method of claim 3 wherein said flow channel defines a slot immediately adjacent the face of said cutter and wherein the step of cutting a chip from the formation comprises the steps of:

extruding a portion of said formation into said slot; and rotating the bit thereby cutting the extruded portion from the formation.

5. The method of claim 4 wherein said method further includes the step of directing a jet of drilling fluid at the extruded formation portion as it enters said plenum thereby dislodging the extruded portion from the formation.

6. The method of claim 1 wherein the step of substantially isolating an earth formation ahead of the drill bit from the plenum comprises the step of urging the cutter against the earth formation.

7. The method of claim 2 wherein said method further includes the step of maintaining such fluid and cut chips internally of said bit body until the same are vented to the annulus between the drill string and the borehole above the cutters on the bit.

8. A method of drilling a borehole comprising the steps of:

providing a drill bit having a cavity formed therein, a cutter formed thereon and a flow channel adjacent the cutter which connects the cavity with the exterior of said bit;

mounting the bit on the end of a drill string;

rotating the drill string;

pumping fluid down the string and into the bit cavity;

urging the cutter against an earth formation;

cutting a chip from the formation;

directing the cut chip into the cavity via the flow channel; and pressurizing the fluid in the drill string until an elastomeric poriton of said bit disposed between said cavity and the surface of said bit expands into sealing engagement with the borehole.

9. A drill comprising:

a bit body having a plenum formed therein;

a plurality of cutters formed on an exterior surface of said body;

a slot formed in said bit body adjacent the face of at least one cutter, said slot having an interior opening directed toward said plenum and an exterior opening directed to the exterior of said body;

a passage for circulating fluid from a drill string to which said body is connectable into said plenum, said passage being constructed and arranged to direct such fluid across the interior side of said slot for flushing cuttings from a formation being drilled into said plenum; and a return flow channel vent formed in said body above said cutters for venting drilling fluid and cuttings from said plenum to the exterior of said bit, said plenum maintaining such fluid and cuttings internally of said bit body until the same are vented via said return flow channel.

10. The drill bit of claim 9 wherein said return flow channel vent is above said cutters thereby venting drilling fluid and cuttings therein from the plenum to the annulus between the drill string and a borehole in which the bit is received above that portion of the borehole being cut when said bit is in operative condition.

11. The drill bit of claim 10 wherein said body includes a crown upon which said cutters are mounted and wherein said cutters include a cutting edge formed on one side of a cutting surface, said cutting surfaces having a portion thereof received in the slot associated with the cutter.

12. The drill bit of claim 11 wherein said cutting edge forms one side of said slot and wherein said crown forms the other side thereof, said cutting edge being positioned outwardly from said bit body relative to said crown.

13. The drill bit of claim 9 wherein said bit body includes an elastomeric portion disposed between said flow channel and the exterior of said bit.

14. The apparatus of claim 9 wherein said apparatus further includes means for substantially isolating an earth formation ahead of the drill bit from said plenum.

15. A method for using a drill bit of the type having a crown with a plurality of cutters formed thereon, said method comprising the steps of:

suspending the bit from a string of drill pipe;

lowering the drill string into a borehole;

urging the bit crown against the bottom of the borehole with a sufficient amount of pressure to sealingly engage substantially all of the borehole bottom with the bit crown;

rotating the drill string thereby cutting chips from the formation; directing cut chips to a plenum formed in the bit via openings formed in the crown adjacent the cutters;

circulating drilling fluid into the plenum and directing the drilling fluid and cut chips from the plenum into the annulus between the drill string and the borehole above that portion of the borehole being cut by the cutters.

16. The method of claim 15 wherein the step of directing cut chips to a plenum formed in the bit comprises the steps of:

extruding a portion of the formation in which the borehole is formed into a crown opening; and further rotating the drill string thereby cutting the extruded portion from the formation.

17. The method of claim 15 wherein the step of circulating fluid into the plenum comprises the step of circulating fluid in said plenum closely adjacent a substantial portion of the surface of said crown thereby cooling the same.

18. The method of claim 15 wherein said method further includes the step of maintaining the drilling fluid and cut chips internally of said bit body until the same are directed from the bit body into the annulus between the drill string and the borehole above that portion of the borehole being cut by the cutters.

19. A method for drilling a borehole in an earth formation comprising the steps of:

embedding a plurality of cutting edges into the formation at the bottom of the borehole;

advancing the cutting edges thereby cutting formation chips from the formation;

injecting drilling fluid into the borehole;

using the drilling fluid to flush the formation chip up said borehole; and sealing substantially all of the bottom of the borehole from the drilling fluid.

20. The method of claim 19 wherein said cutting edges are mounted on a drill bit crown and wherein the step of sealing substantially all of the bottom of the borehole from the drilling fluid comprises the step of urging the crown against the bottom of the borehole.

21. The method of claim 20 wherein said drill bit crown is formed on a drill bit having a plenum formed therein and wherein the step of using the drilling fluid to flush the formation chip up said borehole comprises the step of circulating drilling fluid into said plenum.

22. The method of claim 19 wherein said cutting edges are mounted on a drill bit body having a portion thereof formed from elastomeric material and wherein the step of sealing substantially all of the bottom of the borehole from the drilling fluid comprises the step of deforming said elastomeric material into sealing engagement with a surface of said borehole.

23. The method of claim 19 wherein the step of sealing substantially all of the bottom of the borehole from the drilling fluid comprises the step of sealing substantially all of the bottom around each cutting edge.

24. A method for drilling a borehole in an earth formation comprising the steps of:

embedding a cutting edge mounted on a drill bit body into the formation at the bottom of the borehole;

advancing the cutting edge thereby cutting a formation chip from the formation;

injecting drilling fluid into the borehole;

using the drilling fluid to flush the formation chip up said borehole; and sealing a substantial portion of the bottom of the borehole from the drilling fluid responsive to pressurizing the drilling fluid thereby deforming an elastomeric portion of said drill bit body into sealing engagement with a surface of said borehole.

25. A method for drilling a borehole in an earth formation comprising the steps of:

embedding a cutting edge into the formation at the bottom of the borehole;

advancing the cutting edge thereby cutting a formation chip from the formation;

injecting drilling fluid into the borehole;

using the drilling fluid to flush the formation chip up said borehole;

sealing a substantial portion of the bottom of the borehole from the drilling fluid; and cutting the bottom of the borehole to define a lower borehole surface which extends upwardly between the radially outer surface of the borehole and the centerline of the borehold.

26. The method of claim 25 wherein a filtercake forms on the radially inner surface of the borehole during drilling and wherein said method further comprises the step of cutting into said formation from the radially inner surface of the borehole to a depth beneath the filtercake.

27. The method of claim 26 wherein the step of cutting into said formation from the radially inner surface of the borehole to a depth beneath the filtercake comprises the step of cutting into said formation above the lower borehole surface.

28. A drill bit for drilling a borehole in an earth formation comprising:

a bit body;

a plurality of cutting edges mounted on said bit body;

a plenum formed in said bit body for receiving drilling fluid pumped down a drill string from which said bit is suspended;

means for directing the drilling fluid past said cutting edges for flushing formation chips cut by said cutting edges up said borehole; and means for sealing substantially all of the bottom of the borehole from the drilling fluid.

29. The drill bit of claim 28 wherein said cutting edges are mounted on a drill bit crown and wherein said means for sealing substantially all of the bottom of the borehole from the drilling fluid comprises the surface of said bit crown.

30. The drill bit of claim 28 wherein said means for sealing substantially all of the bottom of the borehole from the drilling fluid comprises an elastomeric member defining a portion of said bit body.

31. The drill bit of claim 28 wherein said drill bit further includes a nozzle formed in said bit body and being operable to direct a jet of drilling fluid toward said cutting edge for flushing cuttings away from the cutting edge.

32. The method of claim 25 wherein said means for sealing substantially all of the bottom of the borehole from the drilling fluid comprises means for scaling substantially all of the bottom around each cutting edge.

33. A drill bit for drilling a borehole in an earth formation comprising:

a bit body;

a cutting edge mounted on said bit body;

a cavity formed in said bit body for receiving drilling fluid pumped down a drill string from which said bit is suspended;

means for directing the drilling fluid past said cutting edge for flushing formation chips cut by said cutting edge up said borehole;

means for sealing a substantial portion of the bottom of the borehole from the drilling fluid, said sealing means comprising an elastomeric member defining a portion of said bit body; and means for deforming said elastomeric member into sealing engagement with a surface of said borehole.

34. The drill bit of claim 33 wherein said deforming means is operable responsive to drilling fluid pressurization.

35. The drill bit of claim 33 wherein said means for directing the drilling fluid past said cutting edge is received within said cavity.

36. A drill bit for drilling a borehole in an earth formation comprising:

a bit body;

a cutting edge mounted on said bit body;

a cavity formed in said bit body for receiving drilling fluid pumped down a drill string from which said bit is suspended;

means for directing the drilling fluid past said cutting edge for flushing formation chips cut by said cutting edge up said borehole;

means for sealing a substantial portion of the bottom of the borehole from the drilling fluid; and a lower surface which extends upwardly between the radially outer surface of said bit and the centerline of said bit.

37. The drill bit of claim 36 wherein a filtercake forms on the radially outer surface of the borehole during drilling and wherein said drill bit further includes a cutter mounted on the radially outer surface of said bit for cutting into said formation from the radially outer surface of the borehole to a depth beneath the filtercake.

38. The drill bit of claim 36 wherein said means for directing the drilling fluid past said cutting edge is received within said cavity.

39. A drill bit for drilling a borehole in an earth formation comprising:

a bit body;

a cutting edge mounted on said bit body;

a cavity formed in said bit body for receiving drilling fluid pumped down a drill string from which said bit is suspended;

means for directing the drilling fluid past said cutting edge for flushing formation chips cut by said cutting edge up said borehole;

means for sealing a substantial portion of the bottom of the borehole from the drilling fluid; and a lower helical surface.

40. The drill bit of claim 39 wherein said cutting edge comprises a blade which extends substantially between the radially outer surface of said bit and the centerline of said bit.

41. The drill bit of claim 40 wherein said bit further includes a slot formed on a lower surface of said bit adjacent said blade.

42. The drill bit of claim 39 wherein said means for directing the drilling fluid past said cutting edge is received within said cavity.

43. A drill bit for drilling a borehole in an earth formation comprising:

a bit body;

a cutting edge mounted on said bit body; and means for limiting the depth of cut mounted on said bit body in front of said cutting edge, said limiting means comprising an abrasive-resistant land mounted on said bit body, said land having a radially outer surface for riding against a formation which the bit is drilling.

44. The drill bit of claim 43 wherein said land and said cutting edge are constructed to wear at substantially the same rate.

45. The drill bit of claim 43 wherein said land surface is located radially inwardly from said cutting edge and wherein the depth of cut is defined by the relative radial positions of the land surface and the cutting edge.

* * * * *

UNITED STATES PATENT AND TRADEMARK OFFICE

CERTIFICATE OF CORRECTION

PATENT NO. : 5,199,511
DATED : April 6, 1993
INVENTOR(S) : Tibbitts, et. al.

It is certified that error appears in the above-indentified patent and that said Letters Patent is hereby corrected as shown below:

Column 2, line 57, change "to" to "of"; (second occurrence).
Column 3, line 65, change "cutter" to "cutters";
Column 4, line 12, change "edge" to "edges"; (second occurrence).
Column 4, line 33, change "cavitite" to cavities";
Column 4, line 55, change "the" to "and"; (first occurrence).
Column 5, line 49, after "reference" insert "to";
Column 5, line 50, change "form" to "from";
Column 7, line 45, after "drill" insert "bit";
Column 8, line 38, change "shpae" to "shape";
Column 10, line 11, after "slot" insert "160";
Column 10, line 45, change "accross" to "across";
Column 11, line 61, change "poriton" to "portion";
Column 11, line 64, after "drill" insert "bit";
Column 14, line 2, change "borehold" to borehole";
Column 14, line 40, change "25" to "28";

Signed and Sealed this

Fifteenth Day of March, 1994

*Attest:*

Bruce Lehman

BRUCE LEHMAN

*Attesting Officer*

*Commissioner of Patents and Trademarks*